US011039987B2

(12) United States Patent
Kroening

(10) Patent No.: US 11,039,987 B2
(45) Date of Patent: Jun. 22, 2021

(54) DEVICE FOR SECURING A PACIFIER IN AN ACCESSIBLE PLACE FOR THE CHILD USER DURING AND BEFORE USE

(71) Applicant: Christine Kroening, Aldie, VA (US)

(72) Inventor: Christine Kroening, Aldie, VA (US)

( * ) Notice: Subject to any disclaimer, the term of this patent is extended or adjusted under 35 U.S.C. 154(b) by 206 days.

(21) Appl. No.: 16/236,985

(22) Filed: Dec. 31, 2018

(65) Prior Publication Data

US 2020/0206089 A1 Jul. 2, 2020

(51) Int. Cl.

| | |
|---|---|
| ***A61J 17/00*** | (2006.01) |
| ***A44B 11/00*** | (2006.01) |
| ***A61J 17/02*** | (2006.01) |

(52) U.S. Cl.

CPC ..... *A61J 17/001* (2015.05); *A44B 11/006* (2013.01); *A61J 17/1115* (2020.05); *A61J 17/02* (2013.01)

(58) Field of Classification Search

CPC ..... A61J 17/001; A61J 17/111; A61J 17/1115; A61J 17/02; A44B 11/006; A61F 2007/0231; A61B 17/135

See application file for complete search history.

(56) References Cited

U.S. PATENT DOCUMENTS

| | | | | |
|---|---|---|---|---|
| 4,719,650 | A * | 1/1988 | Milloy | A61J 17/111 2/49.1 |
| 4,765,037 | A | 8/1988 | Perry | |
| 4,903,698 | A | 2/1990 | Huber et al. | |
| 4,972,980 | A | 11/1990 | Parsons | |
| 4,994,075 | A | 2/1991 | Smith et al. | |
| 5,449,379 | A * | 9/1995 | Hadtke | A61B 17/1325 606/203 |
| 5,593,336 | A | 1/1997 | Thomas | |
| 5,665,113 | A | 9/1997 | Decker et al. | |
| 6,221,093 | B1 | 4/2001 | Prince | |
| 6,269,502 | B1 | 8/2001 | Exstrom | |
| 6,299,501 | B1 | 10/2001 | Lynch | |
| 6,461,214 | B1 * | 10/2002 | Lynch | A61J 17/001 446/73 |
| 7,587,769 | B1 | 9/2009 | McDermott | |
| 2002/0129447 | A1 | 9/2002 | Dunn et al. | |
| 2005/0159779 | A1 | 7/2005 | Schwartz et al. | |
| 2008/0276431 | A1 | 11/2008 | DelPrete et al. | |
| 2010/0082063 | A1 | 4/2010 | Yacktman et al. | |
| 2011/0024599 | A1 * | 2/2011 | Finell | A61J 17/111 248/523 |

(Continued)

FOREIGN PATENT DOCUMENTS

| | | | | |
|---|---|---|---|---|
| WO | WO-2008068785 | A1 * | 6/2008 | A45F 5/02 |

*Primary Examiner* — Ashley L Fishback

(74) *Attorney, Agent, or Firm* — Dunlap Bennett & Ludwig, PLLC

(57) ABSTRACT

A pacifier securement device is provided. The pacifier securement device is adapted to secure a pacifier, of any kind, in a fabric-stuffed elongated tube providing a pacifier compartment with a snap closure to hold the pacifier to a proximal end of the tube. The proximal end snaps and unsnaps to allow for replacement and interchangeability as well as removal of the pacifier for washing and keeping the pacifier sanitary. The device is long enough so that the present invention is able to be snapped, zipped, or tucked into the child's clothing, strapped into the buckles of a car seat or stroller, bundled in a blanket, or snuggled by the infant, while keeping the secured pacifier within oral reach.

6 Claims, 4 Drawing Sheets

(56) References Cited

U.S. PATENT DOCUMENTS

| | | | | |
|---|---|---|---|---|
| 2011/0082502 | A1* | 4/2011 | Gates | A61J 17/001 606/236 |
| 2011/0266319 | A1 | 11/2011 | Jaegar-Waldau et al. | |
| 2012/0006869 | A1 | 1/2012 | McCarty et al. | |
| 2012/0083842 | A1 | 4/2012 | Barton | |
| 2013/0089276 | A1 | 4/2013 | Noble | |
| 2013/0108481 | A1* | 5/2013 | Hoye | F04D 29/601 417/234 |
| 2015/0004872 | A1 | 1/2015 | Taylor | |
| 2015/0017871 | A1 | 1/2015 | Deane | |
| 2016/0008231 | A1 | 1/2016 | Peck | |
| 2016/0174640 | A1 | 6/2016 | Wilkinson et al. | |
| 2017/0020309 | A1 | 1/2017 | Crouch | |
| 2017/0326036 | A1 | 11/2017 | Kim | |
| 2018/0078866 | A1 | 3/2018 | Rogone | |
| 2018/0153225 | A1* | 6/2018 | Walsh | A41B 13/10 |

* cited by examiner

DEVICE FOR SECURING A PACIFIER IN AN ACCESSIBLE PLACE FOR THE CHILD USER DURING AND BEFORE USE

BACKGROUND OF THE INVENTION

The present invention relates to pacifiers and, more particularly, to a device that secures a pacifier to a child accessory so that the child will not lose the pacifier when not in use yet maintain the pacifier in a position the child can readily access it.

Babies orally can have trouble keeping a pacifier in their mouth for numerous reasons and sometimes are unable to keep the pacifier within reach. The pacifier may also slip out and be lost in undisclosed places so that the infant has no way to locate and replace it.

In response, pacifier may be sewn to a stuffed animal or child's toy and, but these approaches do not facilitate connecting the pacifier to the child, because if the toy falls the attached pacifier cannot be recovered by the child, depending on their age.

Another solution is pacifier retainers, but they may be too short to secure to clothing or equipment. Certain pacifier retainers are integrated into clothing or child accessories, and thus the pacifier is not removable, preventing the use of desired types of pacifier and/or making cleaning of the pacifier challenging as the entire accessory would need to be washed and is at risk of breakdown, hence has proven to be choking hazard. Likewise, replacement of the pacifier is impractical without buying a new accessory. In any of these situations, current solutions may leave the baby inconsolable. Moreover, some pacifier retainers can cover the infants face, causing safety risks.

As can be seen, there is a need for a device that facilitates removable securing a pacifier to a child's accessories so that the pacifier is orally accessible yet prevents the pacifier from being lost. The present invention embodies a securement device that secures a pacifier, of any kind, in a fabric-stuffed elongated tube shape that has a pacifier compartment with a snap closure to hold the pacifier to a proximal end of the tube. The pacifier compartment holds the pacifier at one end exposing just the nipple portion for child to suck on. The proximal end snaps and unsnaps to allow for replacement and interchangeability as well as removal of the pacifier for washing and keeping the pacifier sanitary. The device is long enough—typically extending from the child's mouth to their abdomen—so that the present invention is able to be snapped, zipped, or tucked into the child's clothing, strapped into the buckles of a car seat or stroller, bundled in a blanket, or snuggled by the infant, while keeping it within oral reach yet unable to fall. If an infant turns its head or falls asleep, the securement device enables the pacifier to remain within oral vicinity for the child user to rediscover for oral engagement. The present invention also is structured so it does not come close to the face of the baby and it is also soft and comforting and developmentally sound. In addition, the present invention is created to be soothing and comforting to nestle with as a form of security for the child or infant.

SUMMARY OF THE INVENTION

In one aspect of the present invention, a pacifier securement device including the following: an elongated tube extending between a proximal end and a distal end; a flap extending from the proximal end so as to be movable between an open condition and a closed condition engaging the elongated tube; a plurality of soft nubs spaced apart along an outer surface of the elongated tube; a nipple slot disposed in the flap, the nipple slot being dimensioned to easily receive to easily receive a nipple of any type of a pacifier by insertion therethrough so that the closed condition sandwiches a guard of said pacifier between the flap and the elongated tube; a first fastener portion along an inner surface of the flap; and a second fastener portion along an outer surface of the elongated tube so that in the closed condition the first and second fastener portions securely engage.

In another aspect of the present invention pacifier securement device includes the following: an elongated tube extending between a proximal end and a distal end for a distance between twelve and twenty-four inches, wherein the elongated tube is made of soft material; a filling disposed within the elongated tube; a plurality of soft nubs spaced apart along the outer surface of the elongated tube; a flap extending from the proximal end so as to be movable between an open condition and a closed condition engaging the elongated tube; a nipple slot disposed in the flap, the nipple slot being dimensioned to easily receive a nipple of any type of a pacifier by insertion therethrough so that the closed condition sandwiches a guard of said pacifier between the flap and the elongated tube; a first fastener portion along an inner surface of the flap; a second fastener portion along an outer surface of the elongated tube so that in the closed condition the first and second fastener portions securely engage; and a filling disposed within the elongated tube.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a securement device that secures a pacifier, of any kind, in a fabric-stuffed elongated tube shape that has a pacifier compartment with a snap closure to hold the pacifier to a proximal end of the tube. The proximal end snaps and unsnaps to allow for replacement and interchangeability as well as removal of the pacifier for washing and keeping the pacifier sanitary. The device is long enough so that the present invention is able to be snapped, zipped, or tucked into the child's clothing, strapped into the buckles of a car seat or stroller, bundled in a blanket, or snuggled by the infant, while keeping the secured pacifier within oral reach.

Figure 1:
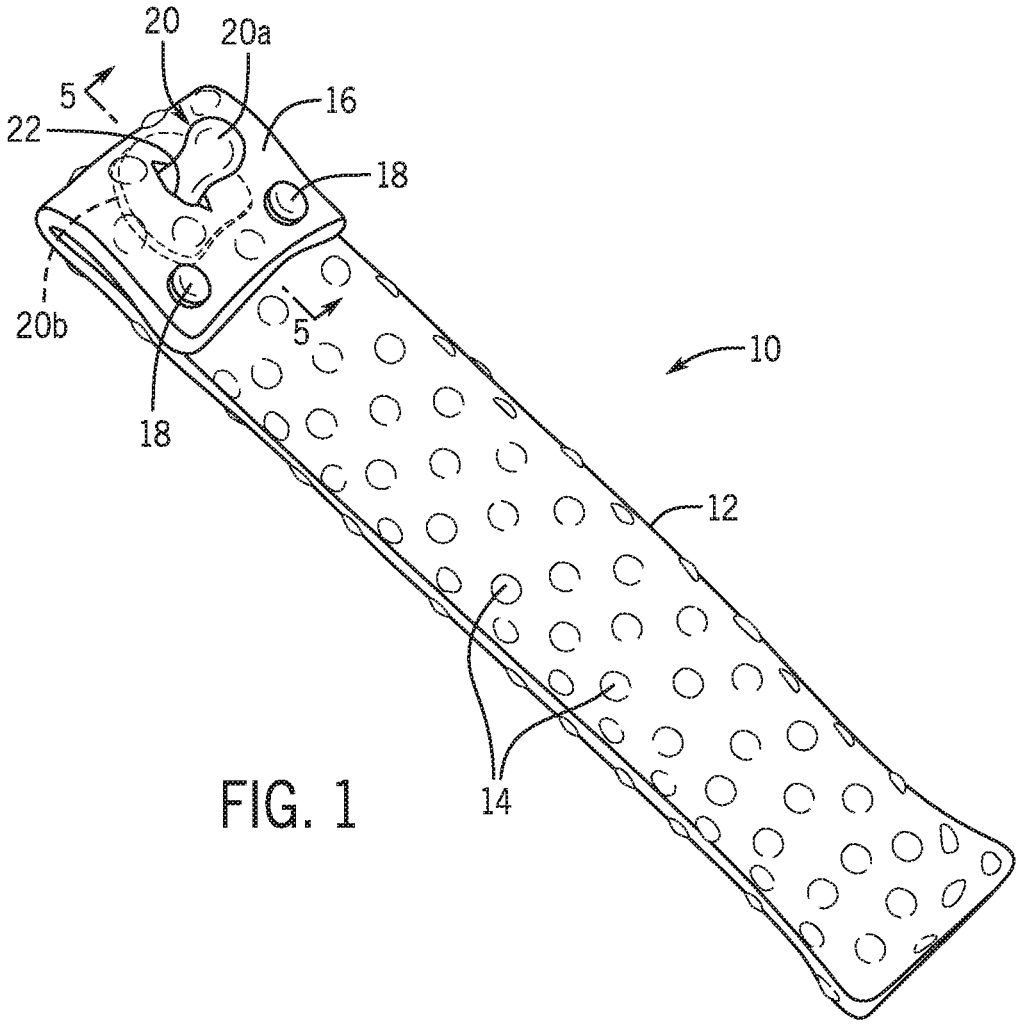
FIG. 1 is a perspective view of an exemplary embodiment of the present invention, shown in use.
Figure 2:
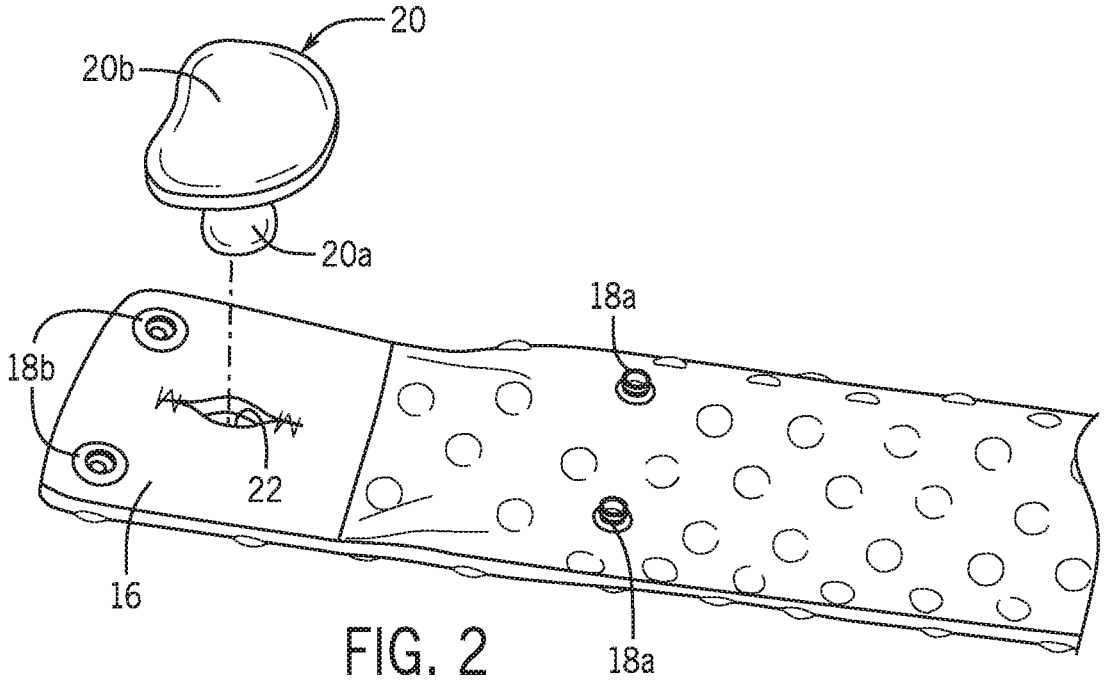
FIG. 2 is an exploded perspective view of an exemplary embodiment of the present invention.
Figure 3:
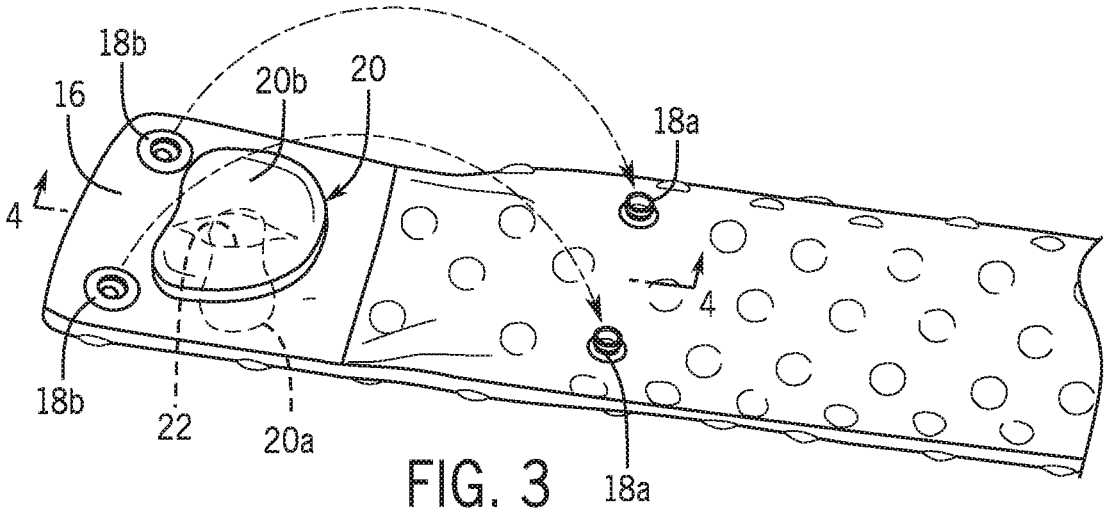
FIG. 3 is a perspective view of an exemplary embodiment of the present invention.
Figure 4:
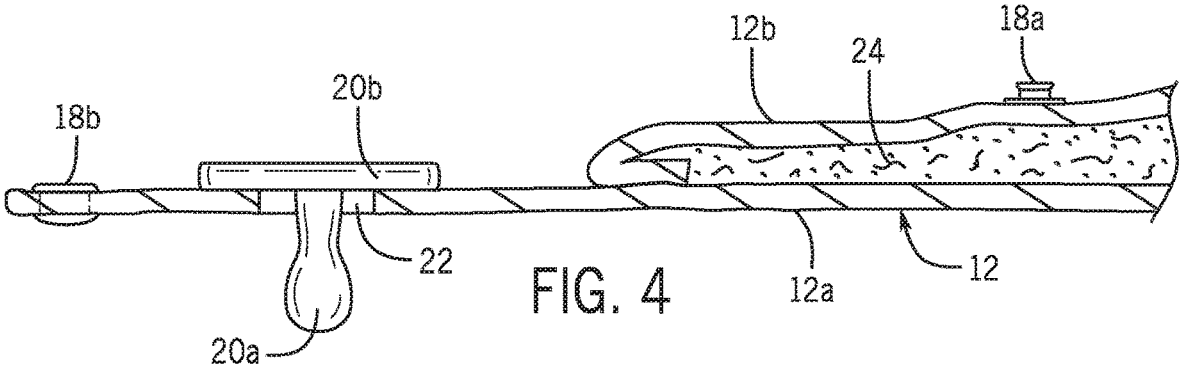
FIG. 4 is a cross-sectional view of an exemplary embodiment of the present invention, taken along line 4-4 in FIG. 3.
Figure 5:
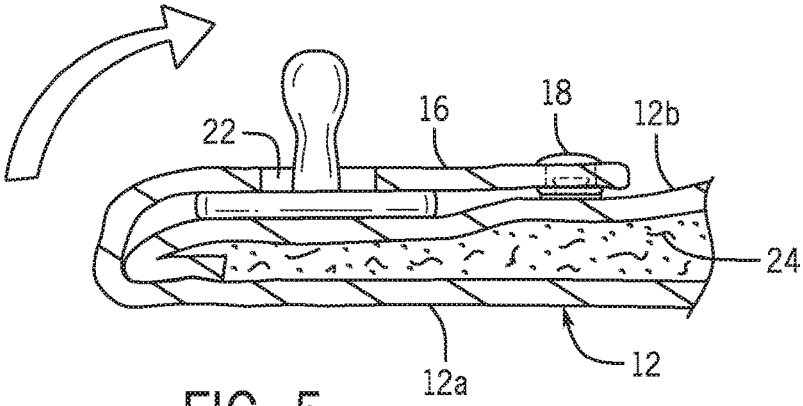
FIG. 5 is a cross-sectional view of an exemplary embodiment of the present invention, taken along line 5-5 in FIG. 1.

Referring to FIGS. 1 through 7, the present invention may include a pacifier securement device 10 providing an elongated tube 12 that extends between twelve and twenty-four inches. The tube 12 may be made of soft and comfortable material. The tube 12 may be defined by a base substrate 12*a* and a cover substrate 12*b* joined so as to defining an inner cavity filled with filling 24. Spaced apart along an outer surface of the elongated tube may be a plurality of nubs 14. The base substrate 12*a* may extend beyond the cover substrate 12*b* along a longitudinal axis of the elongated tube 12 for as to form a flap 16. The flap 16 is movable between an open condition, as illustrated in FIGS. 2 and 3, and a closed condition, as illustrated in FIG. 5, providing a pacifier compartment to secure a pacifier 20 to a distal pacifier securement device 10.

Referring to FIGS. 2 and 3, along an inner surface of the flap 16 may be a flap slit 22 dimensioned and adapted to receive a nipple 20*a* of a pacifier 20 yet too small so that the guard 20*b* of the pacifier 20 cannot pass therethrough, as illustrated in FIG. 3, thereby securing the pacifier 20 in the pacifier compartment. Fasteners 18 may be attached to the flap 16 so that along the inner surface of the flap 16 one or more first portions 18*b* of the fastener 18 are present. The first portions 18*b* may be located in the corners of the flap 16. Along an outer surface of the elongated tube 12 may be second portions 18*a* of the fastener 18 that mate with said first portions 18*b* in the closed conditions, so that the flap 16 is secured to the elongated tube 12.

Figure 6:
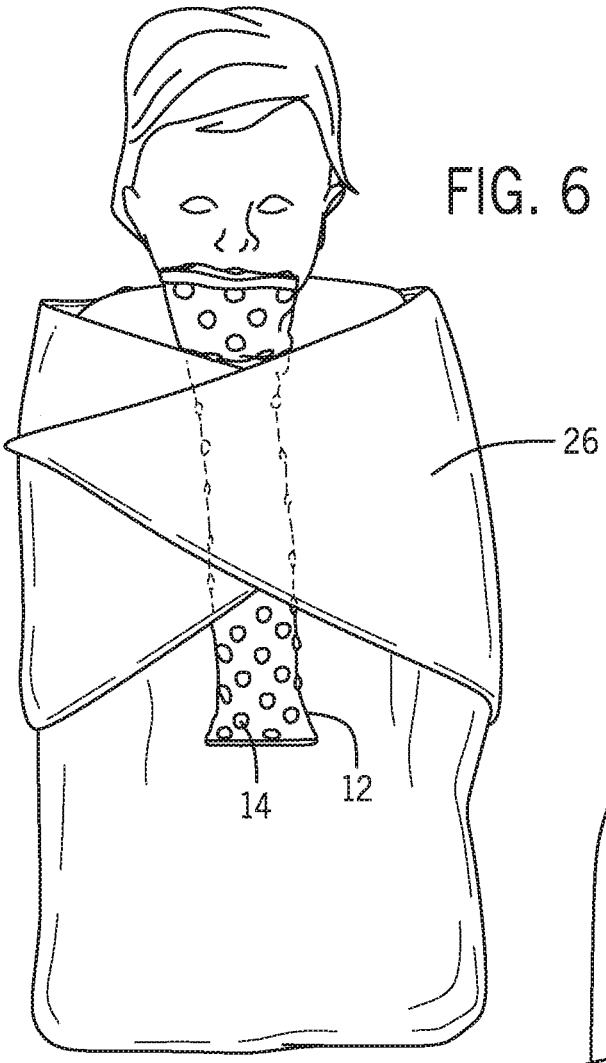
FIG. 6 is a top plan view of an exemplary embodiment of the present invention.
Figure 7:
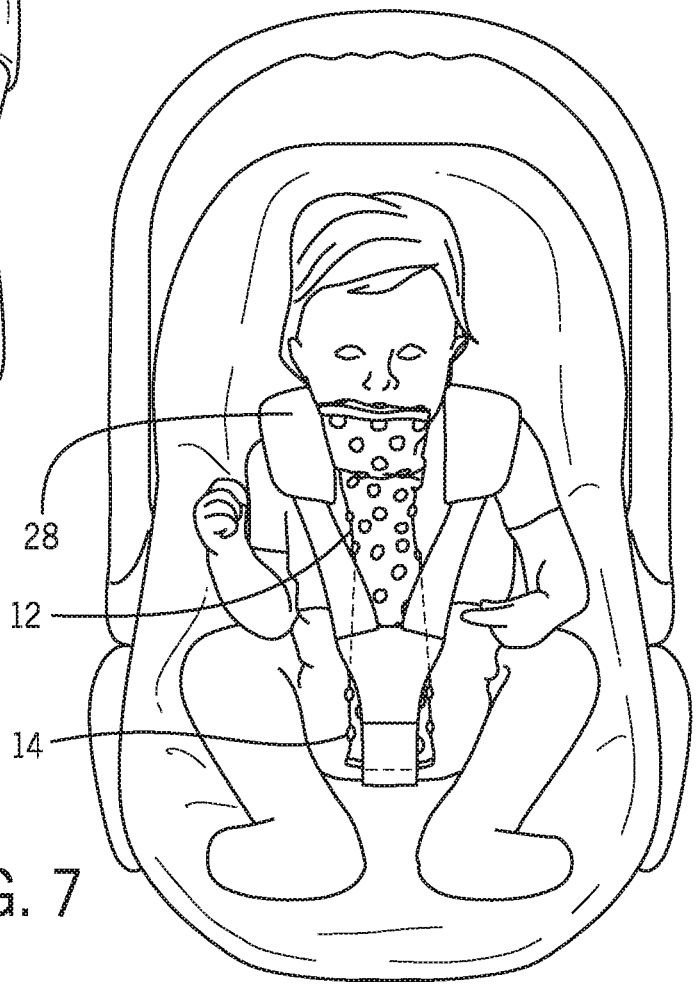
FIG. 7 is a top plan view of an exemplary embodiment of the present invention.

A method of using the present invention may include the following. The pacifier securement device 10 disclosed above may be provided. A user may move the flap 16 to the open condition. Then the user may slide the nipple 20*a* of a pacifier 20 through the flap slit 22 so that it protrudes through an outer surface of the flap 16, as illustrated in FIGS. 4 and 5. Then the user may move the flap 16 to the closed condition so that the first and second portions of the fasteners 18 securely engage, trapping the pacifier 20 in the pacifier compartment. Then an infant or toddler can suck on the pacifier 20 while the distal end of the tube 12 can be tucked away in clothing, sleep sacks 26, portions of strollers, swings, car seats 28 or the like, as illustrated in FIGS. 6 and 7. The pacifier compartment formed by folding the flap 16 in the closed condition removably secures the pacifier 20, and as a result, maintains the pacifier 20 within oral reach. Thus, the pacifier 20 is orally accessible since the secured distal end prevents the proximal end from falling too far away from the baby's mouth. The present invention is also usable as a small soft toy.

A method of manufacturing the present invention may include the following steps. An individual may use a strip of fabric 6-8 inches wide and 12-24 inches long, and fold over the length of the strip of fabric in half making the width three to four inches and joining the sides together. The individual may sew the closed end of the fabric and down the long side leaving one end open, from the sewn end, and forming the foldable flap 16. In the center of the flap 16, the individual may sew a button hole/slit 22 approximately 1-1\2 inches long and, on each corner place, attach a snap closure 18 to the flap 16 with the button hole to the back of the long tube. This creates the pocket for the pacifier at the open end of the tube 12. Then the manufacture may stuff pillow stuffing 24 into the open end until the entire tube 12 is filled and has stiffness and stability.

It should be understood, of course, that the foregoing relates to exemplary embodiments of the invention and that modifications may be made without departing from the spirit and scope of the invention as set forth in the following claims.

What is claimed is:

1. A pacifier securement device, comprising:

an elongated tube extending between a proximal end and a distal end;

a flap extending from the proximal end so as to be movable between an open condition and a closed condition engaging the elongated tube, wherein in the closed condition the elongated tube is linearly oriented;

a plurality of nubs spaced apart along an outer surface of the elongated tube;

a nipple slot disposed in the flap, the nipple slot being dimensioned to slidably receive a nipple of a pacifier therethrough so that the closed condition sandwiches a guard of said pacifier between the flap and the elongated tube;

a first fastener portion along an inner surface of the flap; and a second fastener portion along an outer surface of the elongated tube so that in the closed condition the first and second fastener portions operatively associate.

2. The pacifier securement device of claim 1, further comprising a filling disposed within the elongated tube.

3. The pacifier securement device of claim 1, wherein the elongated tube is made of soft material.

4. The pacifier securement device of claim 1, wherein a distance between the distal and proximal ends of the elongated tube is between twelve and twenty-four inches.

5. A pacifier securement device, comprising:

an elongated tube extending between a proximal end and a distal end for a distance between twelve and twenty-four inches, wherein the elongated tube is made of soft material;

a plurality of soft nubs spaced apart along the outer surface of the elongated tube;

a flap extending from the proximal end so as to be movable between an open condition and a closed condition engaging the elongated tube, wherein in the closed condition the elongated tube is linearly oriented;

a nipple slot disposed in the flap, the nipple slot being dimensioned to slidably receive a nipple of a pacifier therethrough so that the closed condition sandwiches a guard of said pacifier between the flap and the elongated tube;

a first fastener portion along an inner surface of the flap;

a second fastener portion along an outer surface of the elongated tube so that in the closed condition the first and second fastener portions securely engage; and a filling disposed within the elongated tube.

6. A pacifier securement device, comprising:

an elongated tube extending between a proximal end and a distal end;

a flap extending from the proximal end so as to be movable between an open condition and a closed condition engaging the elongated tube, wherein in the closed condition the elongated tube is linearly oriented;

a nipple slot disposed in the flap, the nipple slot being dimensioned to slidably receive a nipple of a pacifier therethrough so that the closed condition sandwiches a guard of said pacifier between the flap and the elongated tube;

a first fastener portion along an inner surface of the flap; and a second fastener portion along an outer surface of the elongated tube so that in the closed condition the first and second fastener portions operatively associate.

* * * * *